US009576457B1

(12) United States Patent
Mona

(10) Patent No.: US 9,576,457 B1
(45) **Date of Patent: *Feb. 21, 2017**

(54) IDENTIFICATION SYSTEM AND METHOD OF USE

(71) Applicant: Todd Mona, Rocky Hill, CT (US)

(72) Inventor: Todd Mona, Rocky Hill, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/044,502

(22) Filed: Feb. 16, 2016

Related U.S. Application Data

(63) Continuation of application No. 13/870,905, filed on Apr. 25, 2013, now Pat. No. 9,262,901.

(60) Provisional application No. 61/637,879, filed on Apr. 25, 2012, provisional application No. 61/789,880, filed on Mar. 15, 2013.

(51) Int. Cl.

| | |
|---|---|
| ***G08B 13/00*** | (2006.01) |
| ***G08B 15/02*** | (2006.01) |
| ***G08B 15/00*** | (2006.01) |
| ***G08B 13/04*** | (2006.01) |
| ***G08B 13/08*** | (2006.01) |

(52) U.S. Cl.
CPC ..... *G08B 15/02* (2013.01); *G08B 13/04* (2013.01); *G08B 13/08* (2013.01); *G08B 15/004* (2013.01)

(58) Field of Classification Search
CPC ..... G08B 12/02; G08B 25/008; G08B 21/18; G08B 13/00; G08B 21/22
See application file for complete search history.

(56) References Cited

U.S. PATENT DOCUMENTS

| | | | | |
|---|---|---|---|---|
| 111,959 | A | 2/1871 | McDowell | |
| 2,909,767 | A | 10/1959 | Zaltman | |
| 3,096,940 | A | 7/1963 | Burleigh | |
| 3,230,912 | A | 1/1966 | Hohmann | |
| 3,653,342 | A | 4/1972 | Chilton | |
| 4,226,194 | A | 10/1980 | Grahn | |
| 4,867,076 | A | 9/1989 | Marcone | |
| 5,208,085 | A | 5/1993 | Pace | |
| 5,402,000 | A * | 3/1995 | Owens, II | G08B 15/02 340/426.28 |
| 5,617,799 | A | 4/1997 | Kaczorowski | |
| 7,779,766 | B2 | 8/2010 | Mullen | |

(Continued)

FOREIGN PATENT DOCUMENTS

| | | |
|---|---|---|
| JP | 6-176277 | 6/1994 |

OTHER PUBLICATIONS

Forensic Marking, http://smartwatercsi.com/smartwater-csi/forensic-marking/, printed Apr. 26, 2013.

(Continued)

*Primary Examiner* — Kerri McNally
*Assistant Examiner* — Renee Dorsey
(74) *Attorney, Agent, or Firm* — McCarter & English, LLP

(57) ABSTRACT

A marking and identification system and method includes a dispersing device configured to disperse marker therefrom when in an activated mode. An activating device is configured to arm the dispersing device from an inactivated mode wherein the dispensing device does not disperse marker to the activated mode. A triggering device is configured to operate the dispersing device and disperse marker when in the activated mode. The marker can be identified at a later time to positively identify a person that triggered the marking and identification system.

26 Claims, 8 Drawing Sheets

(56) References Cited

U.S. PATENT DOCUMENTS

| | | | | |
|---|---|---|---|---|
| 2002/0067259 | A1* | 6/2002 | Fufidio | G07C 9/00031 340/541 |
| 2002/0113697 | A1* | 8/2002 | Kaganer | G08B 13/19634 340/541 |
| 2008/0022919 | A1 | 1/2008 | Ohnstad et al. | |
| 2010/0065463 | A1* | 3/2010 | Taylor | G08B 15/02 206/524.1 |
| 2010/0128123 | A1* | 5/2010 | DiPoala | G08B 13/19619 348/143 |

OTHER PUBLICATIONS

SmartWater, LLC Articles of Organization for Florida Limited Liability Company, Florida Department of State Division of Corporations, http://search.sunbiz.org/Inquiry/CorporationSearch/SearchResultDetail/EntityName/flal-I12000070587-3b946910-6ceb-44d8-b6b0-fab7ff82e09b/SmartWater/Page1, filed May 24, 2012.

* cited by examiner

IDENTIFICATION SYSTEM AND METHOD OF USE

CROSS-REFERENCE TO RELATED APPLICATIONS

This patent application is a continuation of U.S. patent application Ser. No. 13/870,905, filed Apr. 25, 2013, now U.S. Pat. No. 9,262,901, which claims the benefit under 35 U.S.C. §119(e) of similarly-titled U.S. Provisional Application No. 61/637,879 filed Apr. 25, 2012, and similarly-titled U.S. Provisional Application No. 61/789,880 filed Mar. 15, 2013, the contents of which are incorporated by reference in their entireties as part of the present disclosure.

FIELD OF THE INVENTION

This invention relates to marking and identification systems and methods for marking and identifying persons triggering the identification systems.

BACKGROUND OF THE INVENTION

All across the country each year, numerous innocent people and businesses fall victim to robberies and burglaries. According to the Federal Bureaus of Investigation Uniform Crime Reports (2010 nationally collected data), a robbery occurs every 1.4 minutes and a burglary occurs every 14.6 seconds. Ironically, a two-year study comparing 2009 and 2010 arrests for violent (includes robbery) and property crimes (includes burglary) showed a decrease. This means criminals are getting smarter and better at what they do, thus making the job for law enforcement more difficult and solvability rates lower.

There are two crimes in particular that store owners, gas station attendants and store clerks alike nationwide fear the most. The first is the armed robbery. Robberies typically involve some type of weapon carried by the suspect, used to instill fear into the store clerk in order to gain their compliance as the suspect robs the store of money and other items. The second crime is burglary and what police commonly call a "smash and grab." This crime mostly affects those who have a vested interest or ownership of the items inside. Smash and grabs may occur when businesses are closed and the suspect(s) break through a glass door or window to gain entry and steal items inside prior to police arrival.

An example of a smash and grab involves a closed convenience store. Often, limited information of a suspect's description is provided by a store's security camera(s) and/or personnel. Surveillance footage from a camera may show, for example, only a limited description, for example, only that the suspect appears to be a male suspect wearing blue jeans and a white t-shirt. There may be no witnesses to the crime. Police may have nothing more than 20 seconds of video surveillance and possibly a K9 track, if there is a dog available.

At a smash-and-grab type of crime, physical damage may be done to windows or doors for the suspects to gain entry to the location. At the crime scene, a standard alarm system may have notified the police of a break-in or other triggering of the alarm. However, by the time the police arrive, the suspects may have fled, making identification or arrest difficult. Alternatively, the police may arrive prior to or without any alarm notification and may inform the alarm company that there was a break-in. The alarm company then may place a call back to the convenience store's key holder to confirm "the break." When the key holder arrives to the scene, the crime may be determined, such as, by way of example only, 30 cartons of cigarettes missing, which could have a value of approximately $2,100.00. Such is not an atypical type of crime. Although a camera system of the alarm system may be in place to provide images and/or video of the crime, the images and/or video may only offer limited descriptors of the suspect(s), especially if the camera system uses lower resolution or quality cameras, thereby making identification difficult. As described above, the footage may only show, for example, a white male wearing blue jeans and a white shirt that arrived in a small four door red vehicle. The footage may not capture the face of the suspect or any other identifying information, such as a license plate number. Further, fingerprints may not be obtainable because the suspect only touched what was stolen, or wore gloves. Moreover, there may be a significant time delay between when the police arrive at a scene and when the suspect left the scene, thereby making capture less likely.

Police may even later find a red vehicle fitting the description from the footage, seemingly "casing" another closed convenience store in a neighboring town. Police can then initiate a motor vehicle stop. The driver may fit the description from the footage, for example, the driver is a white male wearing blue jeans, white shirt and baseball cap. The driver may even give consent for police to search his vehicle. Due to the lapse of time, though, the police may not discover any further evidence linking the driver to the smash-and-grab from the other jurisdiction. The police may take down the driver's information, but because the police have a lack of probable cause to detain the suspect, i.e., there is no positive identification to link the driver/suspect to the scene of the crime, the driver/suspect must be released.

In the event that the alarm company is notified of a break-in before the police, the alarm company may receive the alarm alert and then proceed to call both the key holder and store to notify of the alarm activation. The alarm company may then follow up with a call to police. Police may then dispatch the notification to officers to be sent to the scene of the alarm. This process adds time between when a crime occurs and when law enforcement responds to the crime. Because of this delay, identification and capture of suspects may be more difficult.

In a second example, such as a robbery of a gas station, in which the robber is wearing all black, police may conduct a K9 track. However, even if the police locate a potential suspect fitting the description provided by a gas station attendant, the located suspect may not be wearing all of the clothing that was observed during the crime, such as gloves, a mask, or may not even be carrying the stolen property. The stolen property may have been stashed away, given to an accomplice, or already pawned, sold, and/or used. Further, although the attendant may have seen the suspect when committing the crime, the victim/attendant may not be able to positively identify the suspect because the suspect may have been wearing a mask. When no positive identification is made, the police may only take the suspect's information and release the suspect because there is no probable cause to make an arrest. Accordingly, lack of a positive identification may prevent arrest of a criminal.

In addition, police must follow various rules and laws when conducting their investigations. If not followed, evidence may be suppressed and a case may be thrown out of court, allowing suspects to walk free and be repeat offenders.

SUMMARY OF THE INVENTION

Generally, the identification system described herein can be non-invasive and place suspect(s) and offenders of crimes back at the scene by positively identifying them with sufficient certainty to meet legal standards of proof, e.g., similar to that of DNA. The identification system incorporates a marker that can be dispersed onto a suspect for later identification. The marker may be a synthetic one-of-a-kind substance that ensures police are able to positively identify the suspect(s) upon detaining them and to subsequently secure convictions in court at trial. In some aspects, the marker may be similar to and mimic that of DNA (each mixture comprised of unique components). One example of such unique marker that can be used with the invention is manufactured by and available from SmartWater CSI, LLC of Fort Lauderdale, Fla., and sold under the trademark SMARTWATER.

The identification system may also act as a liability umbrella for police. Varying state to state with penal code law, police have different parameters as to what elements are needed to make an arrest. The identification system may eliminate the need for various parameters with a legally definitive "yes" or "no" commitment of the crime by a specific suspect. The identification system will also help absolve police of making an arrest in error and be used as a defense to false arrest. The identification system can be used in conjunction with a store's already existing security alarm, or as an independent alarm or protective system.

The identification system may be configured for multiple situations and may be activated and/or triggered in several ways. The identification system can be hard wired into an alarm's panic button behind a register. For example, if a store clerk sees a suspect approaching the store while displaying a firearm, or perhaps the suspect is already inside the store and the clerk observes the suspect pull out a gun, then the clerk can manually press the panic button activating the identification system.

Other aspects may provide for the identification system to include a portable alarm mechanism that can be carried or worn, e.g., by a store clerk. If, for example, the clerk is away from the register and stocking shelves as a suspect enters the store, the identification system may still be utilized. If, for example, the suspect holds up the clerk with a gun while the clerk is away from the register, the clerk can press the portable activation device worn anywhere on his body (e.g., on a necklace, bracelet, belt, fob etc.). For example, the portable activation device can be worn with a clip located on a clerk's belt or simply inside the clerk's pocket allowing the identification system to be triggered remotely, thereby dispersing the marker onto a nearby suspect. Alternatively and/or in addition to remote triggering, a portable activation device worn or carried by an employee may be used to arm and/or activate the identification system, such that when a suspect enters a location, threatens the employee, or takes other hostile or criminal action, the identification system may be armed or activated remotely. Then, when the suspect leaves the location, the identification system may use a proximity sensor, for example, to dispense the marker onto the suspect.

Even further aspects may provide for the identification system to include a voice recognition feature wherein the clerk can activate, arm, or trigger the identification system by speaking, for example, a code word during the course of the crime. If, for example, a clerk is being restrained, held down physically, or assaulted by a suspect(s) and could not reach a manual panic button or remote activator, a voice recognition sensor could be used to active the identification system. When set-up to respond to a certain "word" said by the clerk, the identification system could recognize the voice and once the activating or trigger word is said, the identification system would become active (e.g., armed), or triggered, thus dispersing the marker onto the suspect at the time of triggering, or as he flees the scene of the crime though any access point.

Still further aspects may provide for the identification system to include an automatic arming mechanism that does not rely on a person to activate and arm the identification system. The automatic arming mechanism may be tied to a glass-break detection sensors, may be set to arm when the store is secured at closing, may be tied to a standard alarm system, etc. Other embodiments may provide for the use of facsimile or dummy money stored in a cash register, wherein the fake money includes a mechanism to arm the identification system. For example, if unfortunately the clerk were to be seriously injured or killed in the event of a robbery, or the store were to be closed and no clerk was present to activate and arm the identification system, then the identification system can be activated, armed, or triggered by the identification system's facsimile money being removed from the inside of the register drawer. There may be a magnetic strip inside several obvious, but not easily recognizable, fake bills inside the cash register tray. In the event of a robbery where all the bills are removed from the tray by the suspect(s), the identification system could then be activated, armed, or triggered simply by the removal of the facsimile bills. The removal of the facsimile money causes the separation of the magnetic strips inside the bills from the strips in the drawer, which triggers the system. Other aspects may provide for the fake money to include RFID chips that when passed through an access point of the store, activate or trigger the dispersing mechanism to thereby mark the suspect with the marker. Yet other aspects may provide for a magnetic trigger strip located directly on the countertop or surface, or other triggering element such as a weight sensor, and the identification system may be armed, activated, or triggered when the entire register or other device of value (ATM, safe, etc.) is removed from the surface. Hence, when the suspect activates the identification system, the suspect assists in his own capture.

As noted, an automatic arming mechanism may be tied to a glass-break detection sensor, or tied to the store closing. Specifically, the identification system may be integrated with and/or connected to a standard alarm system of a location, such as a home or business. When so integrated, the identification system may be designed to arm only when the alarm system is tripped or set off. For example, when a standard alarm system is activated or turned on, the identification system may be in a standby mode, or similar setting, but is not armed, thereby preventing inadvertent triggering of the identification system. However, if a suspect activates or triggers the standard alarm system, the identification system automatically arms, such that when a suspect attempts to leave a location or comes into proximity with the identification system after setting off a standard alarm, the suspect may be marked by the identification system.

The identification system thus can allow for unique or high-probability identification of a suspect to a specific location and/or crime, but because the identification system is only armed and then triggered during a standard alarm triggering, it is possible to place the suspect not only at the scene of a crime but at the specific time period of the crime. Accordingly, because of the arming and triggering of the identification system only when a standard alarm system is triggered, authorities can more affirmatively identify a marked suspect and tie such suspect to a specific location, time, and crime.

Other aspects and advantages of the invention will be apparent from the following description and the appended claims.

DETAILED DESCRIPTION OF EMBODIMENTS OF THE INVENTION

Figure 1:
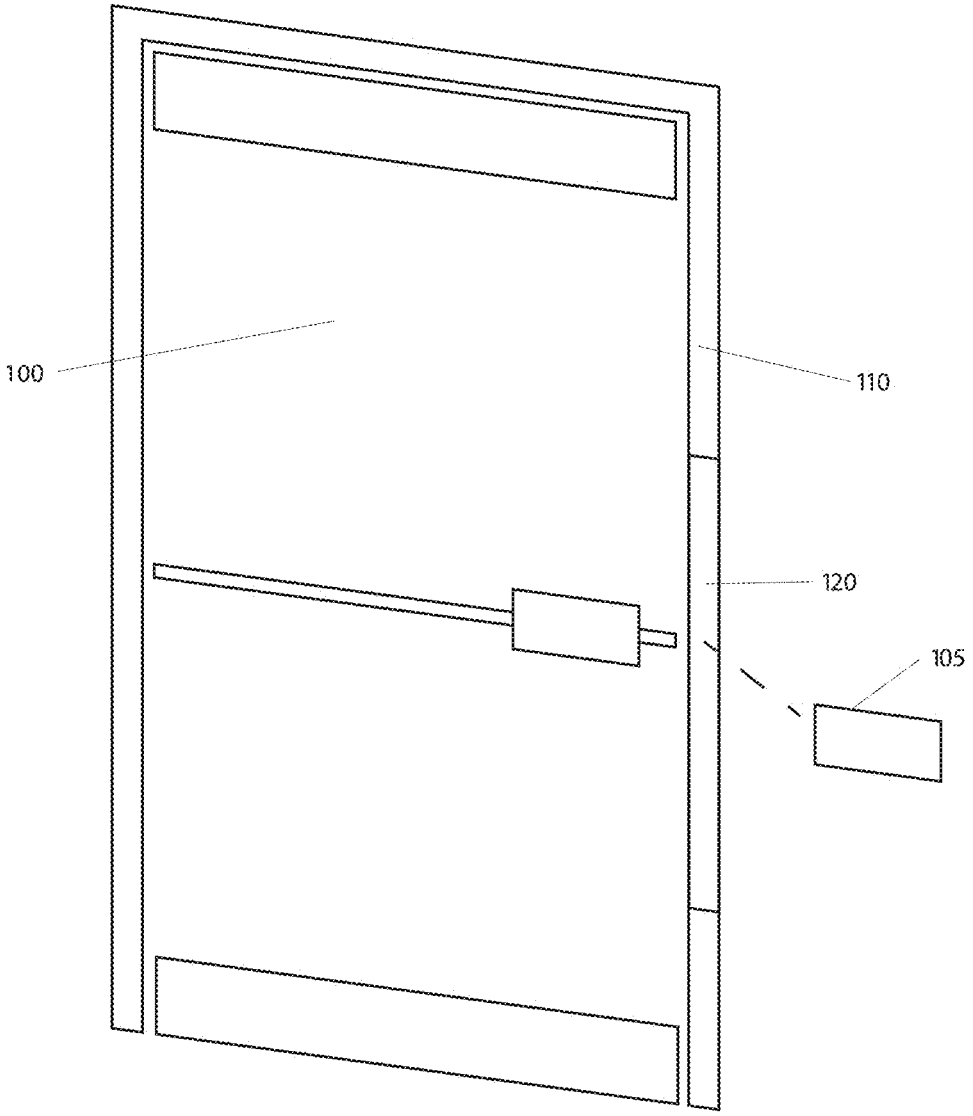
FIG. 1 is a perspective view of an identification system installed in a doorway.

It is to be understood that the present disclosure is not limited in its application to the details of construction and the arrangement of the components set forth in the following description or illustrated in the drawings. The present invention encompasses other embodiments and can be practiced or carried out in various additional ways. As such, the embodiments are not meant to be exhaustive. It is to be understood that the phraseology and terminology employed herein is for the purpose of description and should not be regarded as limiting. Unless otherwise required by context, singular terms may include pluralities and plural terms may include the singular.

Turning now to various aspects of the present disclosure, the solution to, for example, the above-defined problems may be a product called Identi-Theft ("IT"), which may also be referred to as a marking and identification system and method of use. The identification system and method identifies suspects by dispersing an identifying, e.g., a one-of-a-kind, unique, or semi-unique, tagging or marking substance or agent (hereinafter "marker") onto the suspect during the commission of a crime, e.g., as the suspect(s) enter or flee the scene of a crime. The marker may be unique to the specific location and/or identification system of which it is a part. In some embodiments, the marker may be in an aerosol or liquid particulate form and be dispersed by a small expenditure of compressed air or $CO_2$ within the system. The identification system may dispense a small, almost unnoticeable amount of the marker onto the skin or clothing of the suspect(s) as they enter/exit the building or protected area. The marker may be a synthetic one-of-a-kind substance that ensures police are able to positively identify the suspect(s) upon detaining them and to subsequently secure convictions in court at trial. In some aspects, the identification system may have its marker similar to and mimic that of DNA (each mixture comprised of unique components) or other identifiable composition. One example of a suitable marker that can be used with the invention is manufactured by and available from SmartWater CSI, LLC of Fort Lauderdale, Fla., and sold under the trademark SMARTWATER.

In certain aspects, each business/individual/entity that has the identification system installed can be given a detector, such as a light, which can be used by police when they detain or locate a potential suspect (police departments can also be issued the light). The light can then be used to illuminate the marker on the suspect's skin or clothing to determine guilt or innocence. The light may operate at a wavelength (e.g., visible, infrared, ultraviolet, etc.) that corresponds to the chemical and/or physical properties of the marker so as to highlight the presence of the marker on the skin and/or clothing of the suspect(s). Further, depending on the operating wavelength, it may be possible for the suspect to not be aware of the marker, e.g., the marker is not visible in ordinary conditions, e.g., under visible light wave-length, but still enable law enforcement to positively identify a suspect. By way of analogy, a black light (UV) is commonly used by law enforcement to locate certain types of bodily fluids on fabric and skin, it also allows us to see laundry detergent on our clothes. Similarly, in the invention, the light works to illuminate and allow detection of the marker that the identification system has dispersed on the suspect at the scene, making it more difficult, if not impossible, for suspect(s) to deny involvement.

In other aspects, the marker can be identifiable by other mechanisms, permitting law enforcement to identify the suspect(s) using mechanisms in addition to, or other than a light. Another exemplary mechanism is a marker to have an identifiable, e.g., unique, odor associated therewith, wherein law enforcement can use either electronic sensing systems and/or scent dogs to identify the suspect(s). The odor or smell associated with the marker may or may not be made to be detectable by humans, as will be appreciated by one of ordinary skill in the art.

In an even further aspect, the marker may be visible such that law enforcement personnel can readily identify the suspect's involvement. For example, the marker can include an indelible mark on the suspect's skin and/or clothing such that the marker cannot be easily erased or removed by the suspect.

In an exemplary embodiment, the identification system disperses the marker onto the skin or clothing of the suspect(s) without the knowledge of the suspect(s). That is, the marker is dispersed in a manner so that the suspect will not be aware that he or she has been marked with the marker using the identification system, thus greatly improving the opportunity for law enforcement to subsequently detect the marker and place the suspect at the scene of the crime. As discussed above, the identification system may disperse the marker onto the suspect using a small burst of compressed air or $CO_2$ gas, wherein the burst is undetectable by the suspect, e.g., silenced, low pressure, low volume, etc. The marker or marking substance may be uniquely associated with one or more identification systems, or all identification systems, installed in a particular location or area to be protected. Accordingly, it should be understood that using a unique marker or marking substance at a specific location can thus tie a suspect to the location, and not necessarily only to the specific identification system that is triggered at that location.

Figure 2A:
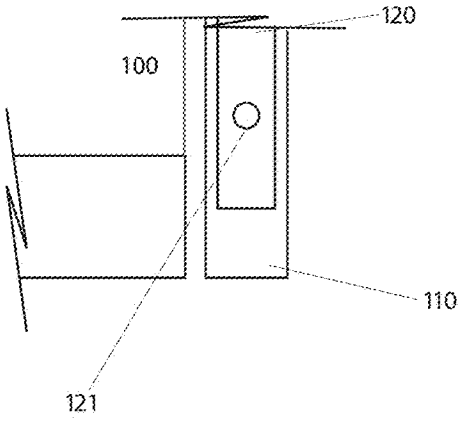
FIG. 2A is an enlarged view of a portion of the identification system of FIG. 1.
Figure 2:
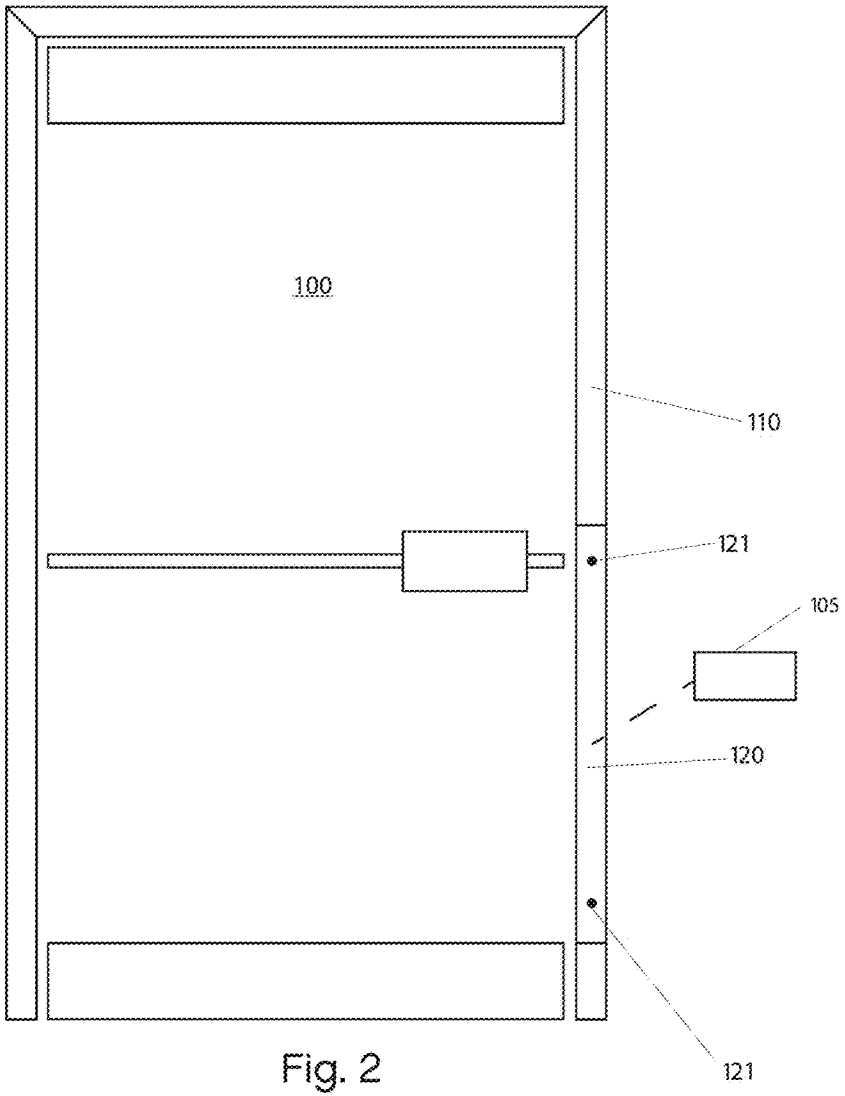
FIG. 2 is a front view of the identification system of FIG. 1.
Figure 3:
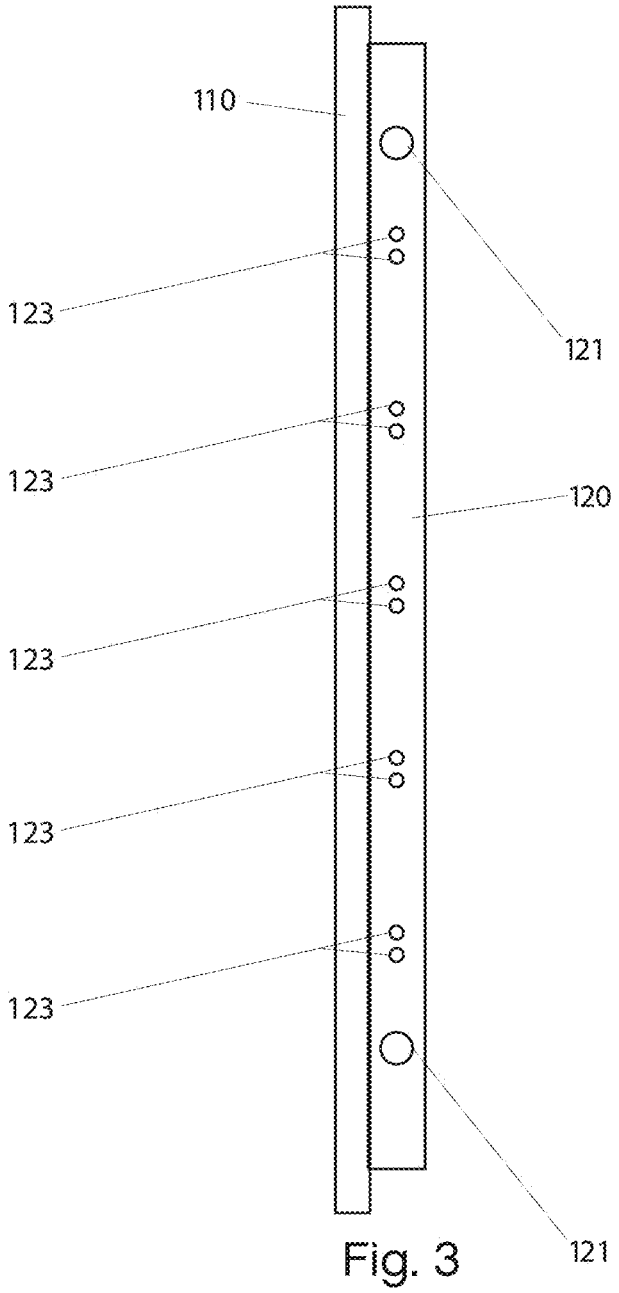
FIG. 3 is a partial enlarged view of the identification system of FIG. 1.

At least a portion of the identification system may include a thin, small box or container that rests or is positioned along the inside of any access point of the protected area or building, e.g., near each door and/or window frame (see FIGS. 1-3). Once activated or armed, as discussed in more detail below, the identification system may disperse the marker onto the suspect(s) as they pass by any one, or all of the access points.

Referring to FIG. 1, a perspective view of a doorway 100 installed with an identification system is shown. Doorway 100 comprises a frame 110. The identification system 120 is installed near, in, or on the door frame 110. The identification system 120 is affixed to the door frame 110 on the inside of the doorway 100, i.e., on the interior-side of the doorway 100 of a room or area. As described herein, the identification system 120 is configured and placed such that the identification system may span approximately the lower half of the doorway 100.

Referring now to FIG. 2, a front view of the doorway 100 is shown with the door closed and showing sensors or triggering devices 121 of identification system 120 of FIG. 1. Sensors 121 may be optical, IR (infrared), laser (visible or not visible light), radar, heat-detecting, motion-detecting, acoustic, ultrasonic, or other types of sensors known or will become known for detecting a person within sensor range of the sensors 121. For example, sensors 121 may be proximity sensors or sensors that are triggered when an optical light is interrupted by a suspect passing through the optical range of the sensors 121. The sensors 121 may operate with a triggering range such that when a person moves or comes within the triggering range, the sensors can detect the person and trigger the identification system 120 to dispenser the marker. In some embodiments, the triggering or sensor range of the sensors 121 may be set or adjustable to detect suspects within a certain range and/or to accommodate the particular area of sensing. In some embodiments, the sensors 121 may be set or adjustable to a triggering threshold that must be met in order to trigger the dispensing. This can include, by way of example only, a degree and/or speed of motion, size (e.g., size of triggering object) and/or intensity (e.g., heat signature) of the triggering signal, or any other sensing criteria that is known or becomes known. This can help avoid "false" or unwanted triggering, e.g., by a guard dog. In one embodiment, for example, the identification system 120 can be configured to trigger/dispense only when multiple sensors 121 are triggered. Triggering of multiple sensors provides a higher probability of the presence of a suspect.

Sensors 121 of identification system 120 trigger a marker to be dispensed therefrom onto a suspect that activates identification system 120. Further, as shown, the identification system 120 may be configured to be discreet, with only the sensors 121 and/or ports (described below) being visible in the frame 110. An enlarged view is shown in FIG. 2A, showing that the identification system 120 can be installed within the door frame 110.

Now referring to FIG. 3, an enlarged view of the identification system 120 of FIG. 1 is shown. As shown, the sensors 121 are disposed at the vertical top and bottom of the identification system 120. Also shown are a plurality of dispensing or dispersing devices 123 configured to dispense marker out of the identification system 120 onto a suspect, e.g., through holes, nozzles, ports or dispensing points in the dispensing device 123. Marking substance can be dispensed out of the dispersing devices 123 in any suitable manner, for example by pressurization, pumping, compressed air, $CO_2$, or other similar means. When the sensors 121 are triggered, after the identification system 120 is activated, the marker may be dispersed by the dispensing devices 123, thereby applying the marker to a triggering suspect that passes near the sensors 121. As described above, the sensors 121 and dispensing devices 123 may be the only visible aspect of the identification system 120 as installed in a frame of a doorway. Further, the sensors 121 and dispensing devices 123 may be discreet and only visible on close inspection of the door frame 110. Alternatively, the triggering devices or sensors may be in a form of a pressure sensor or pressure-sensitive mat on the floor or other surface. Accordingly, the identification system may be triggered and marking substance may be dispensed from the dispensing devices when a suspect steps on or applies pressure to the pressure sensor. The threshold of pressure needed to be applied to the pressure sensor or mat may be set or adjustable. In such embodiments, pressure, e.g., weight, under this threshold would not trigger the identification system. In this manner, accidental or unintended triggering of the system can be mitigated, for example, by a pet.

As an example, the sensors 121 may act similar to a garage door sensor that detects a car passing through the garage door, and the dispensing devices 123 may act similar to a windshield washer sprayer on a vehicle. Although described herein as specific examples, other forms of sensors and/or ports may be used without departing from the scope of the invention. Further, although described as installed in the frame of the doorway, the identification system may be installed in other configurations, such as in the floor or top of the frame, or in another location, such as a window or other point of entry.

Figure 4:
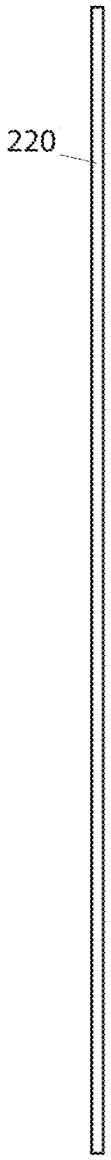
FIG. 4 is a side view of another embodiment of an identification system when not installed in a frame.
Figure 5:
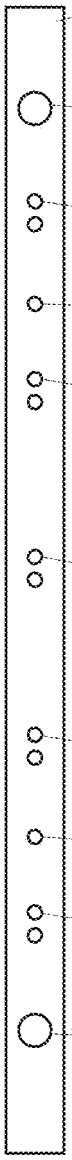
FIG. 5 is a front view of the identification system of FIG. 4 when in a non-active state.
Figure 6:
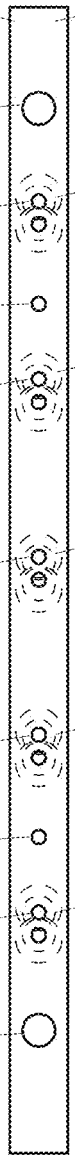
FIG. 6 is a front view of the identification system of FIG. 4 when activated.

Referring now to FIGS. 4-6, an alternative embodiment of the identification system is shown. FIG. 4 shows a side view of an identification system 220 as not installed in a frame. As shown, although not necessarily to scale, the identification system 220 has a slim profile or width to allow for easy and discreet installation within or on a door frame. FIG. 5 is a front view of the identification system 220 with five dispensing devices 223 and two triggering devices or sensor 221. As shown in FIG. 5, identification system 220 is in a non-active on non-dispersing state. FIG. 6 shows the identification system 220 in an active dispersing state. FIG. 6 shows the marker 225 dispersing through dispensing devices 223, providing complete coverage or dispersing area over the height or length of the identification system 220. As discussed above, the identification system may be installed to provide coverage of the lower half of a doorway, and as shown in FIG. 6, the entire area of the lower half of a doorway would be sprayed by the marker 225, allowing for sufficient application to a triggering suspect. Further, as discussed above, the marker may be dispersed as an aerosol or liquid particulate propelled by compressed air or $CO_2$. As should be understood, the identification system can be configured to provide coverage of any portion or portion(s) as desired or suitable for the particular application and/or installation.

Referring again to FIG. 5, the identification system, in some embodiments, may include one or more imaging devices 222, such as, for example, cameras in the illustrated embodiment. As shown, one or more cameras 222 may be installed within or in connection with the identification system 220. The cameras 222 may be configured to operate about the time that the identification system 220 triggers and dispenses marking substance from the ports of the dispensing devices 223, e.g., by operatively connecting the imaging devices 222 to the triggering of the identification system 220. The imaging device 222 would thus capture an image substantially at the time the identification system 220 is triggered. The camera or cameras may be placed at strategic locations so as to obtain one or more images, e.g., take a photo or photos, of a person triggering the identification system. For example, one or more cameras may be placed to capture the face or upper body of a triggering person within the frame of the picture, while the identification system marks the triggering person's clothing and/or shoes. Additionally, the imaging devices 222 may be operatively associated with one or more particular sensors so as to operate (obtain an image) when the particular sensor or sensors are triggered. In such embodiments, the cameras or other imaging devices will take a picture of an area where a triggering person has a higher probability of being located (because he or she set off a sensor), increasing the probability of obtaining an image of the suspect.

Imaging devices used with the identification system may be video cameras, cameras using a flash, IR (infrared) cameras, and/or other types of imaging devices currently known or that will become known. Moreover, one or more cameras may be included with each identification system installed at a location, i.e., one or more cameras for each installation of the identification system. As such, a photograph may be used in combination with the identification system to affirmatively identify a suspect or suspects that commit a crime.

Figure 7:
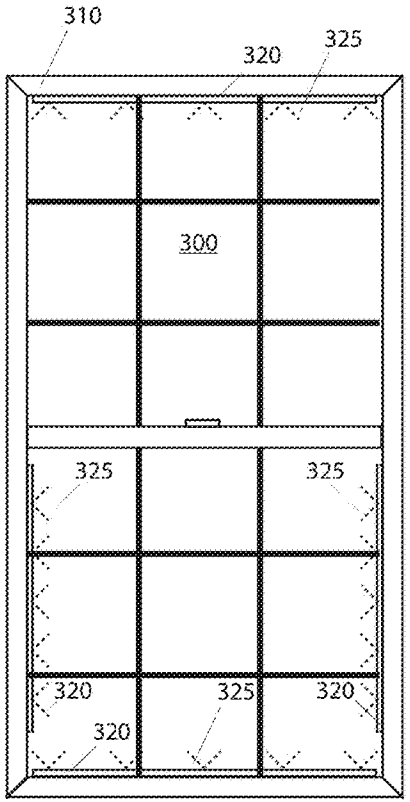
FIG. 7 is a front view of another embodiment of an identification system installed in a window and activated.

Now referring to FIG. 7, an identification system 320 is shown installed in and about the frame 310 of a window 300. As shown, identification system 320 has multiple installation/dispersing points, at the top, bottom, and sides of the window 300. When the identification system 320 is activated, marker 325 may be dispersed from one or more locations, marking a triggering suspect, regardless of where or how the suspect enters or exits through the window 300.

Figure 8:
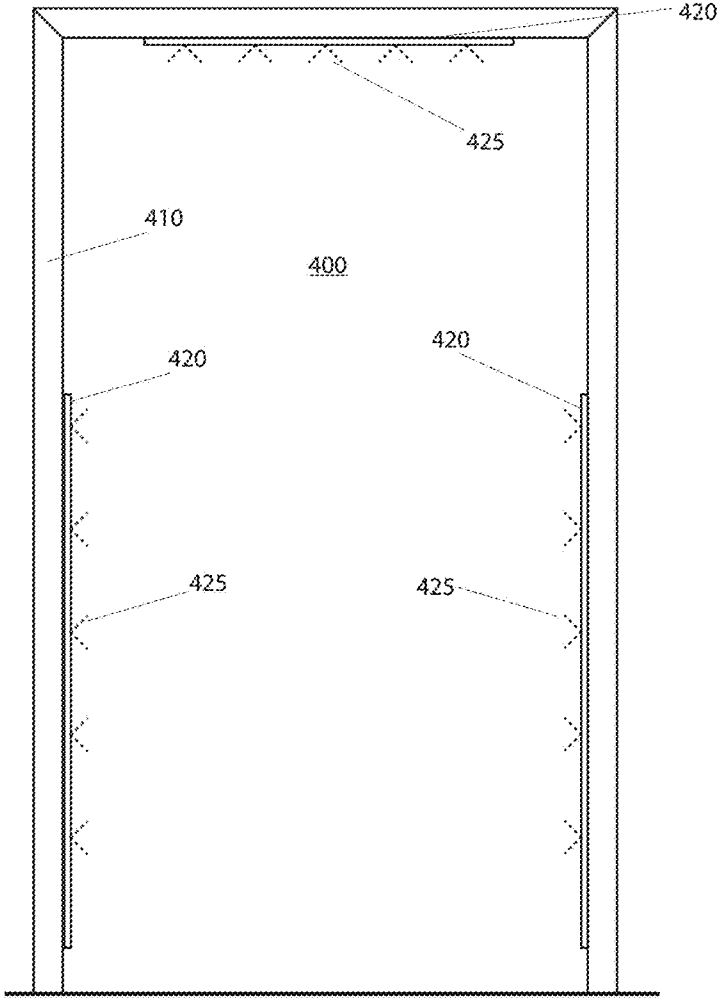
FIG. 8 is a front view of another embodiment of an identification system installed in a doorway and activated.

Similarly, as shown in FIG. 8, multiple dispersing locations may be installed with identification system 420 in a door frame 410 about a door 400. As shown in FIG. 8, identification system 420 is located on both the right and left sides of the frame 410 and also at the top of the door frame 410. The embodiment of FIG. 8 shows the marker 425 dispersing from the identification system 420 on both sides of the door frame 410 and from the top of door frame 410. Again, this allows for dispersal of marker 425 from multiple locations, marking a triggering suspect, regardless of where or how the suspect enters or exits through the door 400.

Although described in FIGS. 7 and 8 in specific exemplary configurations, those skilled in the art will appreciate other configurations or installations about other types of entries and exits.

It is to be understood that the identification system can be activated several ways. Generally, store alarms come with "panic" buttons in case of a robbery. If a person enters a store and brandishes a weapon as they approach the register, or even give off the indication of a potential robbery, the clerk may press the panic button. The identification system may be operatively linked to the panic button, thereby arming the identification system. As the clerk is forced to hand over money, the suspect retrieves the cash and flees out the door for his escape. The identification system has already been armed by the clerk moments before the robbery, and therefore, as the suspect passes by the IT dispersing mechanism as he exits. The identification system releases a small amount of traceable marker onto the suspect.

Figure 9A:
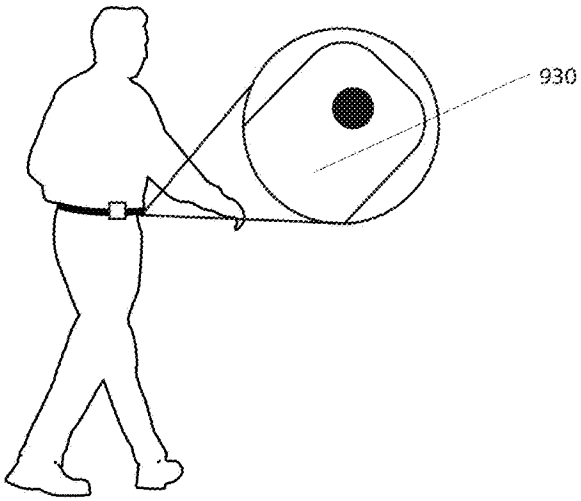
FIGS. 9A-9D show schematic examples of devices that may activate an identification system.

Referring now to FIGS. 9A-9D, various exemplary embodiments of remote devices operatively configured to control the identification system are shown. FIG. 9A schematically shows a panic button device 930, in the illustrated embodiment, worn by an employee. The panic button device 930 may be attached to an employee's belt or other article of clothing or otherwise accessible, such that the employee may operate the identification system when a threat appears, even if they are not near a register. The panic button device 930 allows the employee to always be able to operate the identification system, as the remote device is worn on the person.

Figure 9B:
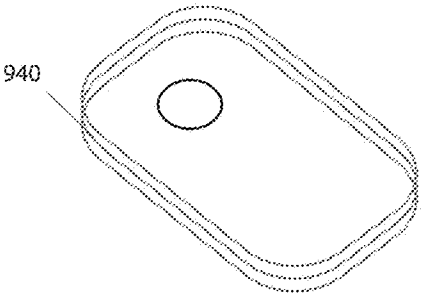

FIG. 9B shows an alternative remote device operatively configured to control the identification system configured as a remote control 940. Remote control 940 may be carried in a pocket of an employee or may be placed in a strategic location in a room, allowing for an employee or other person to operate the identification system when an event occurs. Alternatively still, one or more panic buttons 930 or remote controls 940 may be installed in one or more strategic locations about a room or building.

The remote controls and/or panic buttons may operate via radio (RF), wireless, WiFi, BLUETOOTH™, cellular, infrared, or other transmission methods for wireless devices as is known or may later become known. Accordingly, when the remote control or panic button is operated, a signal may be sent from the remote control or panic button to the identification system or the alarm system to thereby operating the identification system. Alternatively, the remote control or panic button may be configured on a local wireless network or similar system, to allow for remote operation of the identification system from the remote control or panic button.

Figure 9C:
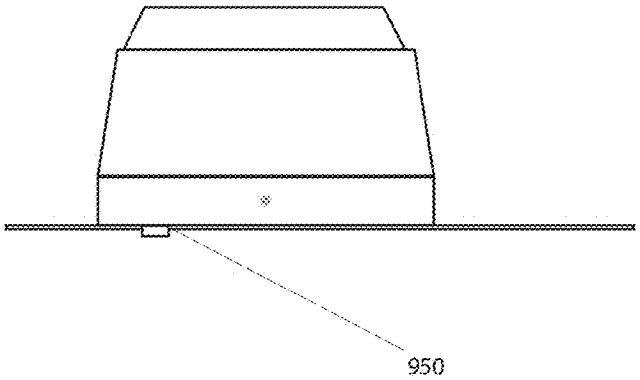
Figure 9D:
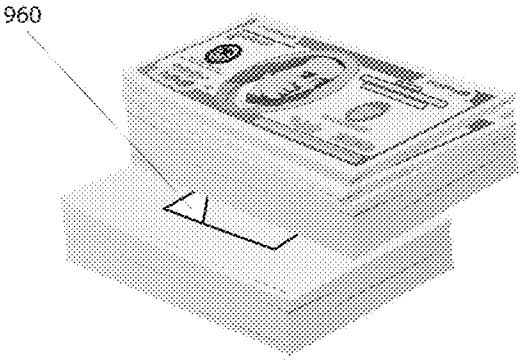

In the embodiment of FIG. 9C, the remote device operatively configured to control the identification system may be a sensor 950 located beneath a cash register or other item of value. When the cash register or other item of value is removed from the sensor 950, the identification system may be operated. The sensor 950 may be a pressure sensor, weight sensor, optical sensor, or other type of sensor known or may become known. Alternatively, as shown in FIG. 9D, a dummy money device 960, as is known, may be used, such that when the dummy money is removed from a register or other location, such as a safe, the dummy money device 960 may operate the identification system.

Once activated and/or armed, the dispersing mechanism of the identification system may be triggered by a motion or proximity detector as the suspect passes by the armed the identification system. That is, the dispersing mechanism may include a proximity detecting sensor oriented across at least a portion of the access point such that, as a suspect passes through the access point, the dispersing mechanism of the armed identification system disperses the marker onto the suspect. In various aspects, the identification system can be configured such that, once armed, the dispersing mechanism will disperse the marker onto the next one, two, or any number of individuals passing through the access point, i.e., individuals passing through the sensing area of the proximity detector. In this manner, multiple suspects that commit the crime can be marked. Some aspects provide for a manual disarming mechanism wherein the store clerk can disarm the identification system once the suspects have fled.

In a scenario where police have detained a suspect related to a crime of a location, the police may employ a specialized light or other detector associated with the location of the crime, e.g., associated with the identification system of the location of the crime. A quick, non-invasive sweep of the detector over the suspect(s) skin and/or clothes may be conducted (which does not invade the suspect's Constitutional rights, e.g., require a search warrant) to determine the presence of the marker on the suspect. The detector, such as a light, may illuminate the suspect(s) clothing where the identification system had dispensed the marker as the suspect passed by the identification system. A positive identification of the marker may allow for a positive identification of a suspect's presence at a crime scene, thereby allowing for arrest of the suspect. In addition to positive identification of the suspect, clothing or other evidence of the marker of the identification system being present on a suspect may be retained as evidence to be used in court.

Referring again to FIG. 1, in some embodiments, the identification system 120 can be operatively connected with an activating device 105 such as a location's glass break or other alarm system. It can be affixed to or positioned near any window or door frame, or other type of entry/exit. Every accessible glass frame and point of entry can have a dispersing mechanism, allowing no window, door, ventilation shaft, etc., to be left vulnerable. The location's glass break system or other alarm system, activating device 105, may activate or arm the identification system 120 upon activation of the alarm. The identification system 120 is then armed to dispense the marker upon triggering of the sensors. Activation of the identification system upon activation/setting of the activating device 105, e.g., alarm system or glass break sensor, assists in marking suspects at the time of a crime, as opposed to other persons who may be at the property at another time. Further, if the activation and/or dispensing times are reported/recorded by the alarm system, activating device 105, and/or identification system 120, the presence of the suspect at the property at the time of the crime is further substantiated.

For example, the alarm system or other activating device 105 may be configured to have an armed state in which it detects the occurrence of a first triggering event, such as a glass break, door opening, motion detection, etc. When the activating device 105, or alarm system, is in the armed state, the activating device may be triggered or "tripped" into a triggered state in response to detection of the occurrence of the first triggering event by the activating device. Conversely, the activating device 105 may also have an unarmed state in which the triggered state is not activated by occurrence of the first triggering event—i.e., the activating device 105 is not set to go off when a triggering event occurs. As such, the activating device 105 may only trigger when in the armed state.

The identification system 120, also referred to as a marking device, may be installed at or near points of entry and exit, such as a doorway 100, of the area protected by the alarm system, activating device 105. The identification system 120, or marking device, may be operatively connected with the activating device 105, or alarm system, and includes a dispensing device 123 (described above in an embodiment as ports 123), configured to dispense marking substance, such as the unique marker or other type of marking substance, therefrom when in an activated state thereof. Further, a triggering device 121 (described above in an embodiment as sensors 121), of the marking system 120 is operatively connected with the dispensing device 123 and configured to detect an occurrence of a second triggering event, such as a person or suspect passing within a triggering range of the triggering device 121. When triggered by the second triggering event, the triggering device 121 places the dispensing device 123 into the activated state. When in the activated state, the dispensing device 123 dispenses marking substance from ports and onto the person triggering the triggering device 121. The marking device 120 may have an armed state in which the triggering device 121 places the dispensing device 123 into the activated state in response to detection of the second triggering event by the triggering device 121, and an unarmed state in which the triggering device 121 does not place the dispensing device 123 into the activated state by occurrence of the second triggering event.

Accordingly, when triggered, the operatively connected activating device 105 may place the marking device 120 into its armed state. Accordingly, triggering of the alarm system, or activating device 105, may arm the identification system 120, or marking device. Then, when the identification system 120 is triggered, by the triggering device 121 thereof, e.g., a sensor detects a person within its triggering or sensor range, the identification system 120 may dispense the marking substance onto a triggering person or suspect thereby marking them for later identification.

In other aspects, the identification system can be activated or armed upon activating or arming a property's alarm system. A subsequent triggering of the identification system, e.g., of the sensor, disperses the marking substance. For example, when a property's alarm system is armed or turned on, for example, upon closing, the identification system is also put into an armed state. A subsequent triggering of the identification system, e.g., the sensor detects a person, will result in dispensing of the marking substance. This will occur regardless of whether the alarm system is triggered or "set off." Such embodiments may mark the suspect even if the suspect evades or deactivates the alarm system. An example of this would be a suspect who hides inside the store or building until closing, and thus does not trigger the door or window alarm(s).

Alternatively, a suspect may trigger the dispersing of the marker, for example, in the case of a glass break alarm, i.e., when the glass breaks, the identification system may trigger, instantly applying the marker to the suspect while breaking the glass. In such embodiments, no separate triggering of a sensor is necessary to dispense the marker.

For example, in a "smash and grab scenario," a suspect may break a store's glass door or window. The glass break detector may directly arm the identification system and/or trigger the identification system to dispense marker, e.g., the identification system proximate to the broken entry. If the property's alarm system is triggered, the alarm system can arm the identification system or systems, which can be selectively armed, for example, based upon the location of the break, e.g., the system(s) proximate to the break. The suspect may then gain entry to the property. At the time of entry, an identification system located at or near the point of entry may trigger to disperse a marker onto the suspect as he or she enters the building Alternatively, the suspect may trigger an identification system at some other location within the protected area or when exiting the building.

For example, a suspect may quickly enter a building after breaking a glass door, and take property from the location. When the glass is broken, an alarm system may be triggered, thereby arming the identification system. As the suspect exits the store, the suspect may pass through an entry or exit having an armed identification system. The proximity of the suspect to the sensors of the identification system, such as at or within a triggering range, will activate the dispensers and the suspect may be marked with a marker by the identification system. Accordingly, although the suspect may have very quickly committed a crime and be ahead of a police response, the suspect may still be marked to the location and, at least in some embodiments, the time of the crime. As such, even if the suspect stashes, sells, uses, or otherwise disposes of the stolen property, the suspect may be marked such that identification of the suspect may be positively made.

When the suspect is preliminarily identified and possibly stopped or detained, such as based on surveillance footage or witness description, the police may retrieve a detector associated with the particular identification system of the crime, or other detector that may be used with the identification system, to detect the marker on the detained suspect. A quick scan over the suspect's arm with the detector, such as a light, illuminates or identifies the marker on the suspect's skin or clothing. Accordingly, the suspect can be positively identified and an arrest may be made. At the time of booking the suspect, the police may wipe the suspect's skin with a transfer media, such as a napkin, to transfer the marker for retention and collection. This process provides visual confirmation on scene (illumination at the time of detention) and the transfer media (now containing the marker as trace evidence) can be tagged and logged into property as evidence bringing closure to the crime(s).

Crimes mentioned herein are very serious in nature and come as both a personal attack on the innocent and an invasion of one's privacy. These crimes usually occur at night making the job of police more difficult. More often than not police have little physical evidence, trace evidence and witnesses to these crimes. Even when police are able to locate and detain a possible suspect(s) they are still faced with the difficult task of placing the suspect(s) at the scene. The identification system, as described herein, increases the efficiency and ease of identifying suspects and accurately placing them at the scene of a crime.

Turning now to additional features of the present disclosure, it is to be understood that the present disclosure may be embodied in a number of variations, implementations, and the like, within the scope of the present disclosure. Certain aspects may provide for the identification system to be implemented as a small device that can be placed at each access point for a building, business, office, home, etc., as described above. Other aspects may provide for at least a portion of the presently disclosed inventive functions to be performed using one or more computing systems processing computer executable instructions, wherein the computing device is in communication with the individual dispensing mechanisms positioned at the access points for the facility. Even further aspects may provide for the identification system to include a computing system located at the building wherein the computing system is in communication with one or more remote monitoring systems.

Figure 10:
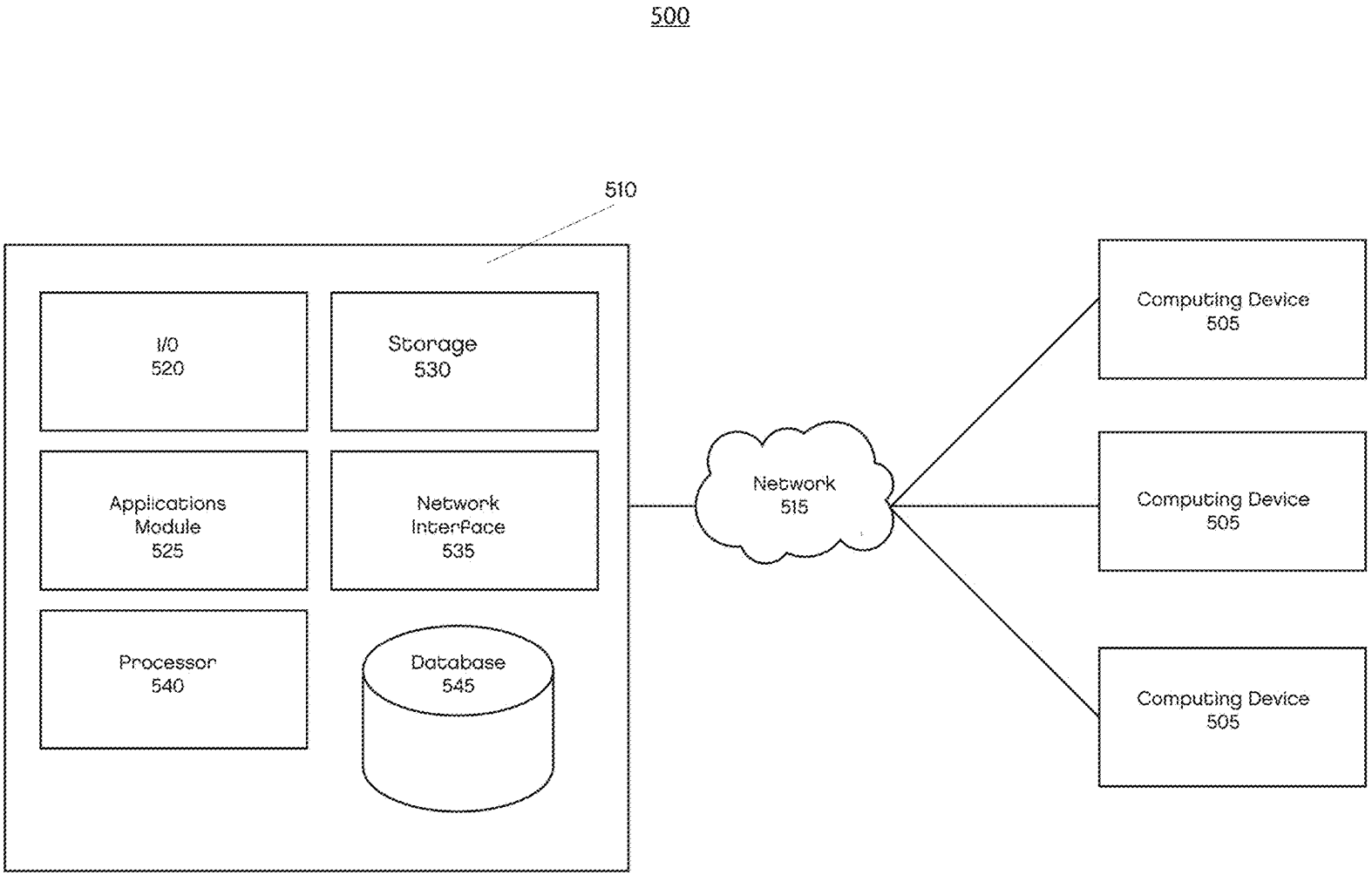
FIG. 10 is a schematic view of a computer system for use with an identification system.

For example, and referring now to FIG. 10, shown therein is an exemplary architecture of a system 500 which may be adapted to practice aspects of the identification system. That is, the exemplary architecture illustrated in FIG. 10 includes hardware, software, and/or combinations thereof, adapted to implement certain aspects of the identification system. The exemplary architecture is provided by way of example only and is not intended to be limiting. Changes and variations to the exemplary architecture illustrated in FIG. 10 are considered within the scope of the present disclosure.

A module (or application) is generally understood as a collection of routines that perform various system-level functions and may be dynamically loaded and unloaded by hardware and device drivers, as required. The modular software components described herein may also be incorporated as part of a larger software platform or integrated as part of an application specific component.

The system 500 illustrated in FIG. 10 includes one or more computing devices 505 (three being shown in FIG. 10 by way of example) coupled to a processing system 510 via a network 515. The system is not limited to three computing devices 505, other numbers of devices may be used. Although FIG. 10 shows one processing system 510 communicating through the network 515 with three computing devices 505, it is to be understood that the system 500 can include more than one processing systems 510 (e.g., more than one server or a distributed server arrangement) communicating with more or less computing devices 505.

Generally, the computing device 505 may be associated with one or more users, e.g., one or more of a home, business, or other brick-and-mortar location, etc. The computing device 505 may be adapted to permit the user (e.g., individual, business owner, etc.) to communicate, or otherwise interface with the processing system 510, via the network 515. The computing device 505 can include component(s), logic instructions, and/or combinations thereof, adapted to permit the user to interface with the processing system 510 to, for example, (1) communicate data or information indicative of the arming or activating of the identification system, triggering of the identification system, and/or discharge of the marker, e.g., occurrence, time, etc. (2) communicate the status of the identification system (e.g., wherein the processing system is embodied as a central or remote monitoring service servicing multiple users), (3) communicate data or information indicative properties of the marker associated with the user, and/or (4) transmit (automatically or on demand) one or more notifications via, for example, the network 515, e.g., activation of system, discharged of marker, etc.

The computing device 505 may be adapted to permit the user to interface with the processing system 510 using, for example, a web browser or remote application (e.g., smartphone, tablet, laptop, etc.), to transmit/receive data over the network 515. The data for the one or more users may be stored on the processing system 510 rather than being downloaded to the computing device 505. The users may access the processing system 510 through and using, for example, a series of web pages accessible via the web browser operating on the computing device 505. The computing device 505 may include components, logic instructions, and/or combinations thereof adapted to system status, properties, and the like, to the processing system 510.

In yet another aspect, the computing device 505 can be adapted to permit the user to interface with the processing system 510 via the network 515 to download information relating to the user (e.g., other crimes in the geographical area, economics, similar business types, demographics, or other categories) to the computing device 505 and to then upload or otherwise provide the information to the processing system 510.

The computing device 505 may include any computerized system that can implement a web browser application or other suitable applications adapted to request and provide information to and from the processing system 510 via the network 515. Exemplary systems adapted to implement the computing device 505 include, but are not limited to, a general purpose computing system, a personal computer, a laptop computer, a netbook, a personal digital assistant (PDA), a smart phone, an e-reader, and/or equivalents thereof. Exemplary software applications included on the computing device 505 include a web browser application, a word processor application, a time tracking application, a communication application, as well as a wide variety of applications understood by one having ordinary skill in the art.

Broadly, the network 515 may be adapted to provide a communications medium to permit the one or more computing devices 505 to communicate with the processing system 510, and vice versa. The network 515 can be implemented via the World Wide Web (WWW), a wide area network (WAN), a local area network (LAN), the Internet, an intranet, Ethernet, a wireless network, a cellular telephone network, and/or equivalents or combinations thereof.

Generally, the processing system 510 may operate as a central or remote monitoring system implementing at least a portion of the identification system. In one example, the monitoring/control functions of the identification system may be carried out using the processing system 510 wherein the computing devices 505 acts as dumb-terminals facilitating communication between the individual dispensing mechanisms and the processing system 510. Other aspects may provide for the computing device 505 to perform the operation/control portions of the identification system wherein the processing system 510 serves monitoring/notice functions and/or communication with local authorities. Even further aspects may provide for implementation of the identification system without the processing system 510 wherein the computing device 505 includes instructions and/or hardware to perform the control, monitoring, communication functions disclosed herein.

The processing system 510 may include component(s), logic instructions, and/or combinations thereof, adapted to implement at least a portion of the currently described and claimed inventive concept(s)/functions. The processing system 510 may include instructions stored on non-transitory computer readable medium that when executed causes the processing system to implement the present technology.

As shown in FIG. 10, the processing system 510 may include an input/output (I/O) module 520, an applications module 525, a storage module 530, a network interface module 535, a processor 540, and one or more databases 545. The I/O module 520 includes hardware, logic, and/or combinations thereof that may permit an administrator to interface, operate, or otherwise control the processing system 510. Exemplary components included as a part of the I/O module 520 may include a keyboard, a mouse, a monitor, a pointing device, a printer, a scanner, and equivalents and/or combinations thereof.

The applications module 525 may include one or more of programs, applications, logic instructions, and computer executable code adapted to operate the processing system 510 as well as to carry out at least a portion of the currently described and claimed inventive concept(s). The storage module 530 may store, for example, the programs and/or applications, operating protocols, and the like, as well as a variety of other processing system 510 parameters, as would be understood in the art. The network interface module 535 may be adapted, or otherwise configured to enable the processing system 510 to communicate via the network 515. The processor 540 may include components, logic instructions, and/or combinations thereof adapted to generally operate the processor system 510.

The database 545 may include, for example, information relating to one or more of user data, remote monitoring system, etc. Although shown as a single database, the database 545 can be implemented as a plurality of internal or external databases, e.g., a relational database, object database, virtual database, and the like.

It is to be understood that the description provided above regarding the particularities of the exemplary architecture implementing the processing system 510 is provided by way of example and is not to be considered limiting. The processing system 510 may be implemented as described above or with a variety of modifications and/or changes to the architecture without departing from the particular functions described herein. For example, the processing system 510 may be implemented as a stand-alone server, as a web server, as a distributed server system, as an application server, in combination with a database server, etc. When the processing system 510 is implemented as a webserver, the processing system 510 may communicate with the computing device 505, via the network 515, through a series of web pages. The processing system 510 may be implemented as a single web server or as a distributed processing system including a plurality of server(s) coupled to one or more databases, either locally or remotely.

Figure 11:
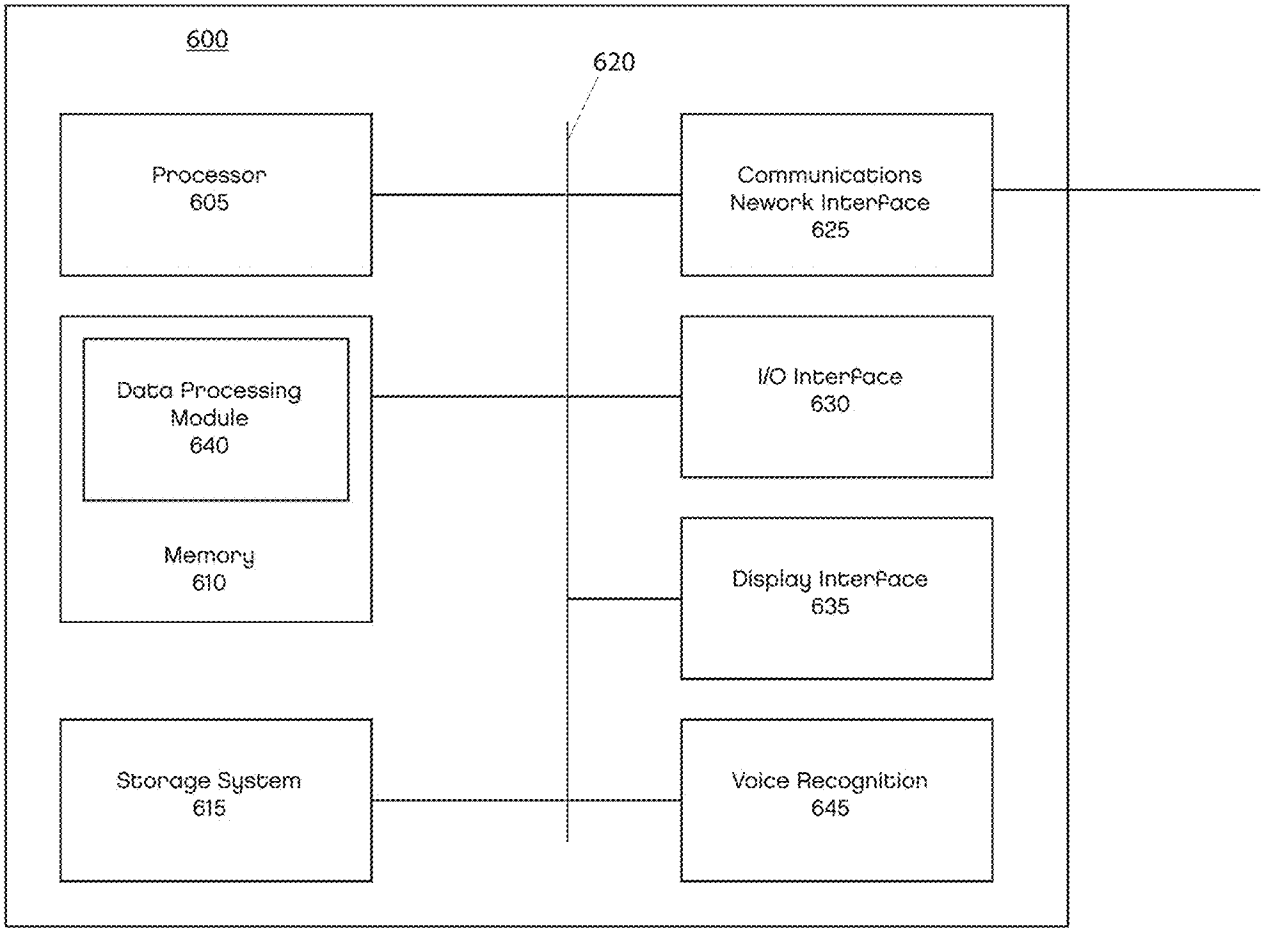
FIG. 11 a block diagram of a computer system for use with an identification system.

FIG. 11 is a block diagram of an exemplary system 600 that may be utilized in accordance with certain aspects of the present disclosure. The system 600 may be used to implement the computing device 505 of FIG. 10. That is, the system 600 may be an exemplary system including logic, instructions, hardware, or combinations thereof that permit the system 600 to implement the identification system, or portions thereof, described and disclosed herein. Generally, one or more of system 600 may be included in each location implementing the identification system. The system 600 may be configured to interface, control, monitor, and the like, the functions implementing the identification system. Moreover, the system 600 may integrate and or interface with a standard alarm system. When system 600 is integrated with a standard alarm system, the control functions control the identification system to arm when the standard alarm system is triggered, e.g., a glass-break or door or window sensor, a motion detector, etc., and then control the identification system to dispense the marker when a proximity sensor or other trigger is activated by a suspect.

The system 600 may include one or more processors 605 and memory 610. The memory 610 may store, in part, instructions and data for execution by the processor 605. The memory 610 may store executable code when in operation. The memory 610 may include a data processing module 640 for processing data. The system 600 may further include a storage system 615, communication network interface 625, input and output (I/O) interface(s) 630, and display interface 635. The components shown in FIG. 11 are depicted as being communicatively coupled via a bus 620. The components may be communicatively coupled via one or more data transport means. The processor 605 and memory 610 may be communicatively coupled via a local microprocessor bus, and the storage system 615 and display interface 635 may be communicatively coupled via one or more input/output (I/O) buses. The communications network interface 625 may communicate with other digital devices (not shown) via a communications medium.

The storage system 615 may include a mass storage device and portable storage medium drive(s). The mass storage device may be implemented with a magnetic disk drive or an optical disk drive, which may be a non-volatile storage device for storing data and instructions for use by the processor 605. The mass storage device can store system software for implementing embodiments according to the present technology for purposes of loading that software into the memory 610. Some examples of the memory 610 may include RAM and ROM. A portable storage device, as part of the storage system 615, may operate in conjunction with a portable non-volatile storage medium, such as a floppy disk, compact disk or digital video disc (DVD), to input and output data and code to and from the system 600 of FIG. 11.

System software for implementing various embodiments and/or functions of the identification system may be stored on such a portable medium and input to the system 600 via the portable storage device. The memory and storage system of the system 600 may include a non-transitory computer-readable storage medium having stored thereon instructions executable by a processor to perform, at least partially, the presently disclosed technology. The instructions may include software used to implement modules discussed herein, and other modules.

I/O interfaces 630 may provide a portion of a user interface, receive audio/video input, and provide audio/video output. The I/O interfaces 630 may include an alphanumeric keypad, such as a keyboard, for inputting alphanumeric and other information, or a pointing device, such as a mouse, trackball, stylus, or cursor direction keys. I/O interfaces 630 may also communicate with the one, or more preferably a plurality of, dispensing mechanism(s) positioned at access points throughout the structure. In one embodiment, the I/O interface 630 may be in electric communication with the dispensing mechanisms via a wired connection, a wireless connection, an optical connection, a radio-frequency connection, other types of communication methods, or combinations thereof. Other aspects may provide for the I/O interface 630 of the system 600 to be in communication with the arming or triggering devices (e.g., the panic button, the motion detectors, RFID, activation of a standard alarm system, etc.).

The system 600 may further include a voice recognition module 645. The module 645 may include an audio input configured to permit a user to arm or trigger the identification system using voice commands. The module 645 may include instructions and the like configured to receive the arming or triggering word being spoken by the user, process the received audio from the user to identify the speaker and the arming or triggering word, and arm or trigger the identification system upon confirmation that the correct user has spoken the correct arming or triggering word.

The display interface 635 may include a liquid crystal display (LCD) or other suitable display device. The display interface 635 may receive textual and graphical information, and process the information for output to the display interface 635.

While the present invention has been described in connection with a series of preferred embodiments, these descriptions are not intended to limit the scope of the invention to the particular forms set forth herein. The above description is illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents. The present descriptions are intended to cover such alternatives, modifications, and equivalents as may be included within the spirit and scope of the invention as defined by the appended claims and otherwise appreciated by one of ordinary skill in the art. In several respects, embodiments of the present invention may act to close the loopholes in the current industry practices in which good business practices and logic are lacking because it is not feasible to implement with current resources and tools.

While the disclosure has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

What is claimed is:

1. An identification system, comprising:

an activating device having an armed state configured to detect an occurrence of a first triggering event when the activating device is in the armed state and place the activating device into a triggered state in response to detection of an occurrence of the first triggering event by the activating device, a triggered state that is activated in response to detection of the first triggering event by the activating device, and an unarmed state in which the triggered state is not activated by occurrence of the first triggering event;

at least one imaging device configured to capture an image within an imaging frame defined by said at least one imaging device;

and a marking device comprising:

a dispensing device configured to dispense marking substance therefrom when in an activated state thereof; and a triggering device operatively connected with the dispensing device and configured to detect an occurrence of a second triggering event and place the dispensing device into the activated state, thereby dispensing marking substance therefrom, wherein the marking device has an armed state in which the triggering device places the dispensing device into the activated state in response to detection of the second triggering event by the triggering device, and an unarmed state in which the triggering device does not place the dispensing device into the activated state by occurrence of the second triggering event, and wherein the activating device and marking device are operatively connected with each other, and the activating device is further configured to place the marking device into the armed state thereof when the triggered state of the activating device is activated.

2. An identification system of claim 1, wherein the dispensing device is disposed adjacent to or within a frame of an entry or exit of a room and the dispensing device is configured to dispense marking substance when a person or object is adjacent or within said entry or exit.

3. An identification system of claim 1, wherein the activating device is located at a first location and the marking device is located at a second location.

4. An identification system of claim 1, wherein the activating device comprises an alarm system configured to, when the alarm system is triggered by the first triggering event, place the marking device into the armed state thereof.

5. An identification system of claim 1, wherein the triggering device comprises a sensor configured to detect the second triggering event comprising a person or object passing within a triggering range of the triggering device, and the triggering device is configured to place the dispensing device into the activated state, thereby dispensing marking substance onto the detected person or object.

6. An identification system of claim 1, wherein the marking substance comprises a unique marker suitable to associate a person or object marked with the marking substance with the marking device.

7. An identification system of claim 1, wherein the marking substance comprises a unique marker uniquely associated with the marking device.

8. An identification system of claim 1, wherein the marking substance is detectable by at least one of visible light, ultra-violet light, and odor.

9. An identification system of claim 1, wherein the activating device comprises an alarm system having one or more alarm sensors comprising at least one of motion detectors, glass break detectors, door opening sensors, and window opening sensors, and wherein the first triggering event includes activation of the one or more alarm sensors.

10. An identification system of claim 9, wherein the second triggering event comprises a person or object passing within a triggering range of the triggering device.

11. An identification system comprising:

a dispensing device configured to dispense therefrom a unique marking substance uniquely associated with the dispensing device when in an activated state thereof;

a triggering device operatively connected with the dispensing device and configured to detect an occurrence of a triggering event and place the dispensing device into the activated state, thereby dispensing the unique marking substance therefrom, and at least one imaging device configured to capture an image within an imaging frame defined by said at least one imaging device;

wherein the dispensing device has an armed state in which the triggering device places the dispensing device into the activated state in response to detection of the triggering event by the triggering device, and an unarmed state in which the triggering device does not place the dispensing device into the activated state by occurrence of the triggering event.

12. An identification system of claim 11, wherein the marking substance is suitable to associate a person or object marked with the marking substance with the dispensing device.

13. A method comprising:

arming an activating device into an armed state in which the activating device is configured to detect an occurrence of a first triggering event and place the activating device into a triggered state in response to detection of an occurrence of the first triggering event thereby from an unarmed state in which the triggered state is not activated by occurrence of the first triggering event;

detecting the first triggering event with the activating device when in the armed state;

triggering the activating device in response to the detection of the first triggering event;

arming a marking device comprising a dispensing device configured to dispense marking substance therefrom when in an activated state thereof and a triggering device operatively connected with the dispensing device and configured to detect an occurrence of a second triggering event and place the dispensing device into the activated state, thereby dispensing marking substance therefrom, and operatively connected with the activating device, to place the marking device into an armed state in response to the triggering of the activating device in which the marking device is configured to place the dispensing device into the activated state in response to detection of the second triggering event by the triggering device, from an unarmed state in which the triggering device does not place the dispensing device into the activated state by occurrence of the second triggering event;

detecting the second triggering event with the triggering device while the marking device is armed; and dispensing marking substance from the dispensing device onto a person or object;

wherein the method further includes capturing at least one image of at least a portion of said person or object.

14. A method of claim 13, further comprising detecting marking substance on the person or object after marking substance has been dispensed onto the person or object thereby identifying the person or object that triggered the marking device.

15. A method of claim 13, wherein the dispensing step includes dispensing a marking substance comprising a unique marker uniquely associated with the marking device.

16. A method of 13, wherein the dispensing step includes dispensing a marking substance comprising a unique marker suitable to associate the person or object marked with the marking substance with the marking device.

17. A method of claim 13, wherein the activating device comprises an alarm system and performing the step of arming the marking device in response to triggering of the alarm system in response to the first triggering event.

18. A method of claim 13, wherein the marking device is installed adjacent to or within a frame of an entry or exit of a room and the dispensing step includes dispensing marking substance when the person or object is adjacent or within said entry or exit.

19. A method of claim 13, wherein the marking substance is detectable by at least one of visible light, ultra-violet light, and odor, and the method further comprising detecting the marking substance with at least one of visible light, ultra-violet light, and odor.

20. A method of claim 13, wherein the step of detecting the second triggering event comprises detecting a person or object within a triggering range of the marking device.

21. A method of claim 13, wherein said capturing step is performed at about a time of one or more of (a) occurrence of the second triggering event; (b) performance of said detecting step; or (c) performance of said dispensing step.

22. A method of identification, the method comprising:

arming an activating device into an armed state in which the activating device is configured to detect an occurrence of a first triggering event and place the activating device into a triggered state in response to detection of an occurrence of the first triggering event thereby from an unarmed state in which the triggered state is not activated by occurrence of the first triggering event;

detecting the first triggering event with the activating device when in the armed state;

triggering the activating device in response to the detection of the first triggering event;

arming a marking device comprising a dispensing device configured to dispense marking substance therefrom when in an activated state thereof and a triggering device operatively connected with the dispensing device and configured to detect an occurrence of a second triggering event and place the dispensing device into the activated state, thereby dispensing marking substance therefrom, and operatively connected with the activating device, to place the marking device into an armed state in response to the triggering of the activating device in which the marking device is configured to place the dispensing device into the activated state in response to detection of the second triggering event by the triggering device, from an unarmed state in which the triggering device does not place the dispensing device into the activated state by occurrence of the second triggering event;

detecting the second triggering event with the triggering device while the marking device is armed; and dispensing marking substance from the dispensing device onto a person or object;

wherein the method further includes installing marking substance into the dispensing device.

23. An identification system of claim 1, wherein the at one least imaging device is operatively connected to the triggering device and configured to capture an image at about a time of one or more of (a) occurrence of the second triggering event; (b) detection of the second triggering event; or (c) dispensing of marking substance from the dispensing device.

24. An identification system of claim 1, wherein the at least one imaging device is operatively connected to at least sensor and is configured to capture an image upon triggering or activation of said at least one sensor.

25. An identification system of claim 11, wherein the at least one imaging device is operatively connected to the triggering device and configured to capture an image at about a time of occurrence of the triggering event.

26. An identification system of claim 11, wherein the at least one imaging device is operatively connected to at least one sensor and is configured to capture an image upon triggering or activation of said at least one sensor.

* * * * *